United States Patent [19]

Naylor

[11] 4,182,080

[45] Jan. 8, 1980

[54] SECTIONALIZED DOOR FOR A BARN OR SIMILAR STRUCTURE

[76] Inventor: Donald B. Naylor, Rte. 4, Box 357, Plymouth, Ind. 46563

[21] Appl. No.: 877,953

[22] Filed: Feb. 15, 1978

Related U.S. Application Data

[63] Continuation-in-part of Ser. No. 769,264, Feb. 16, 1977, abandoned.

[51] Int. Cl.[2] ..... E05D 13/00; E05D 15/48

[52] U.S. Cl. ..... 49/410; 49/163; 49/169; 49/501; 49/504; 52/588; 52/595; 52/795

[58] Field of Search ..... 52/588, 593, 455, 457, 52/595, 795; 49/410, 411, 409, 404, 143, 168, 501, 504, 163, 166, 169

[56] References Cited

U.S. PATENT DOCUMENTS

| | | | |
|---|---|---|---|
| 1,079,922 | 11/1913 | Rumsey et al. | 49/410 |
| 3,129,793 | 4/1964 | Ferrell | 52/593 |
| 3,166,801 | 1/1965 | Provenzo | 49/410 |
| 3,301,149 | 1/1967 | Box | 52/593 X |
| 3,357,146 | 12/1967 | Gartrell | 52/595 |
| 3,568,388 | 3/1971 | Flachbarth et al. | 52/588 |
| 3,625,808 | 12/1971 | Martin | 52/595 X |
| 3,724,078 | 4/1973 | Carlin et al. | 52/177 |
| 3,830,027 | 8/1974 | Paisley et al. | 52/204 |
| 4,037,379 | 7/1977 | Ozanne | 52/593 X |
| 4,044,511 | 8/1977 | Lingle | 52/593 |

FOREIGN PATENT DOCUMENTS

| | | | |
|---|---|---|---|
| 1075935 | 10/1954 | France | 49/410 |

*Primary Examiner*—J. Karl Bell

*Attorney, Agent, or Firm*—Oltsch, Knoblock & Hall

[57] ABSTRACT

A sectionalized door for a barn or similar structure including a plurality of separable panels positioned side by side and fitted together by tongue and groove connections. Top and bottom rails extend across the upper and lower marginal edges respectively of the connected panels.

12 Claims, 14 Drawing Figures

Fig. 1
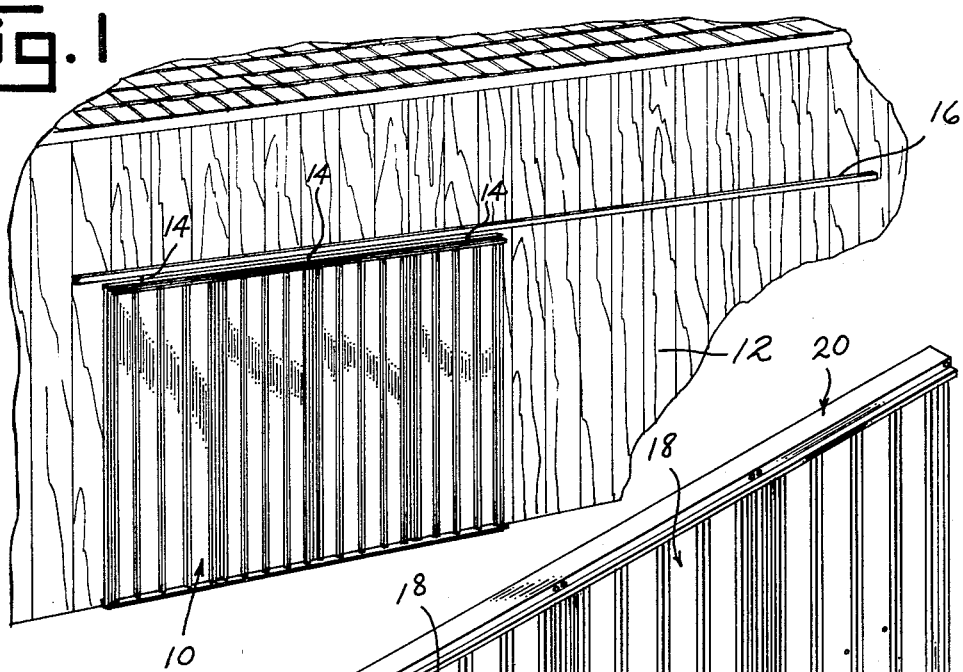
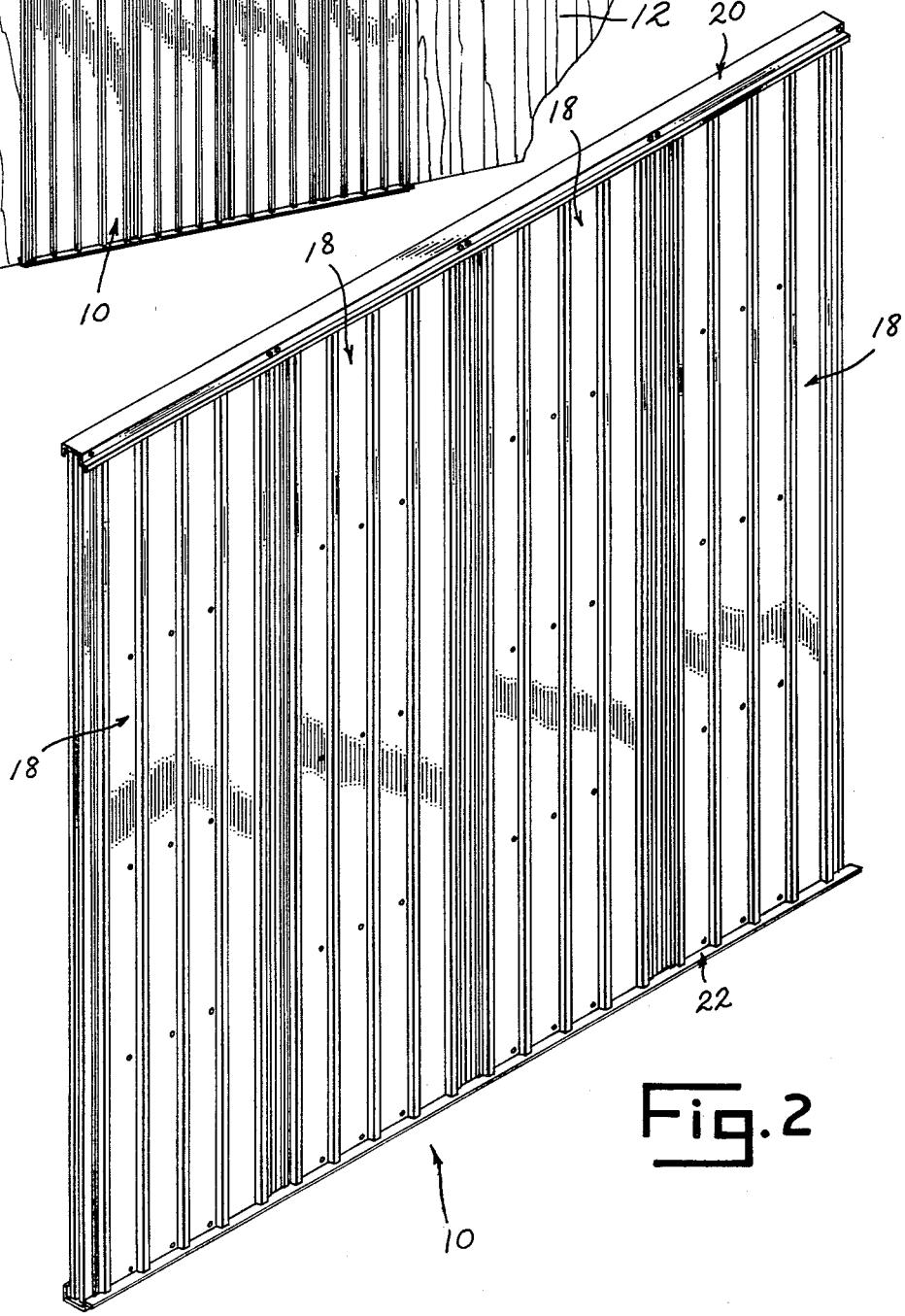
Fig. 2

SECTIONALIZED DOOR FOR A BARN OR SIMILAR STRUCTURE

CROSS-REFERENCE TO RELATED APPLICATION

This is a continuation-in-part of application Ser. No. 769,264, filed Feb. 16, 1977 now abandoned.

SUMMARY OF THE INVENTION

This invention relates to a sectionalized door and will have particular but not limited application to sliding doors for a barn or similar structure.

The door of this invention includes a plurality of separable panel parts, each of selected width and height. Each panel part includes two vertical frame supports between which girders extend and are preferably overlayed with siding. One frame support of each panel part is formed into a tongue connection, while the other frame support of the panel part is formed into a groove connection.

A plurality of panel parts having specific height and width are selected to accommodate the desired size of the door. The panel parts are joined in a side by side relationship with the tongue connection of one panel part fitting into the groove connection of an adjacent panel part. A channel-shaped top rail is applied over the upper marginal edges of the joined panel parts and a channel-shaped bottom rail is applied over the bottom marginal edges of the panel parts, with both rails extending from one end panel part to the other end panel part. Fastener means, such as screws, are then utilized to connect the top and bottom rails to the panel parts. If the door is to be utilized as a sliding door, hangers carrying rollers or similar apparatus are then connected to the top rail for connection to the guide and support rail which is connected to the barn or other building structure.

By providing a sectionalized door consisting of multiple panel parts, the door user may select the number and size of panel parts to accommodate his needs, and then simply assemble the door at the building structure site. Special skills and tooling are not required to assemble the door of this invention. Additionally, the supplier or distributor of the door need only keep a minimum inventory of parts since the variation in door size is determined by the particular size of the panel parts utilized in the door. Also, since the door is in disassembled stored form, the distributor or supplier need only utilize a minimum of storage space for his inventory.

Accordingly, it is an object of this invention to provide a door which is for a barn or similar structure and which is in sectionalized, easily assembled form.

Another object of this invention is to provide a door for mounting to a barn or similar structure in which a plurality of connectable panel parts are provided from which the user of the door can choose to size his door depending upon the number and size of panel parts utilized.

And still another object of this invention is to provide a method of sizing and assembling a door for a barn or similar structure in a simplified manner with only the use of ordinary hand tools.

And still another object of this invention is to provide a sliding door having a hinged access door.

Other objects of this invention will become apparent upon a reading of the invention's description.

BRIEF DESCRIPTION OF THE DRAWINGS

FIG. 1 is a perspective view of the door mounted to a barn.

FIG. 2 is a perspective view of the door in assembled form.

DESCRIPTION OF THE PREFERRED EMBODIMENTS

The preferred embodiments illustrated are not intended to be exhaustive or to limit the invention to the precise forms disclosed. They are chosen and described in order to best explain the principles of the invention and its application and practical use to thereby enable others skilled in the art to best utilize the invention.

Door 10 of this invention is illustrated in FIG. 1 as being connected to a barn 12 for sliding movement to expose the door opening into the barn. Hangers 14 which include rollers (not shown) are connected to door 10 and a roller guide and support rail 16 is attached to barn 12 above the door opening. Hangers 14 and rail 16 are of standard construction and serve to support door 10 for its shiftable movement in a manner well known in the art.

Figure 3:
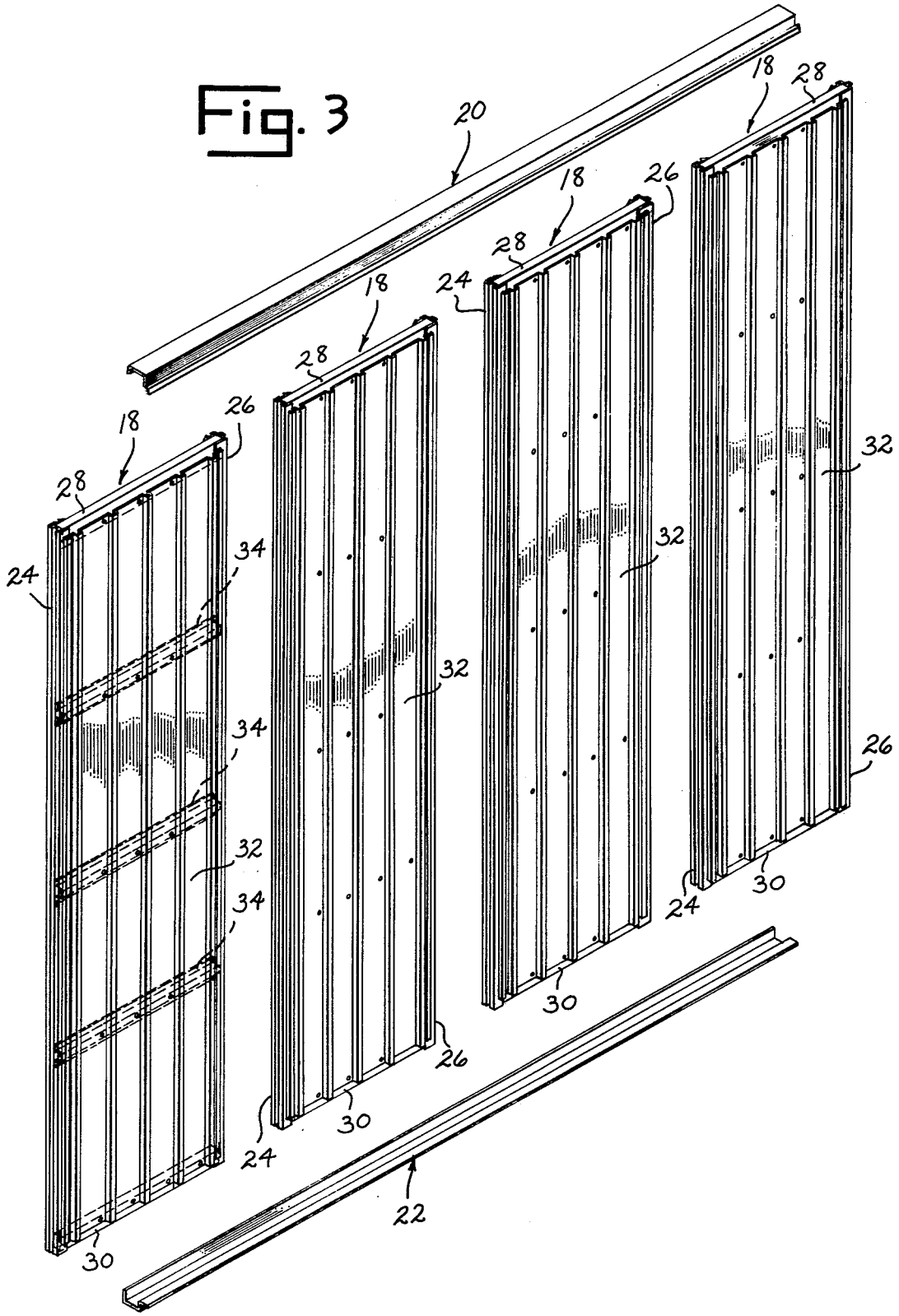
FIG. 3 is a perspective view of the door showing the component parts thereof in separated form.
Figure 4:
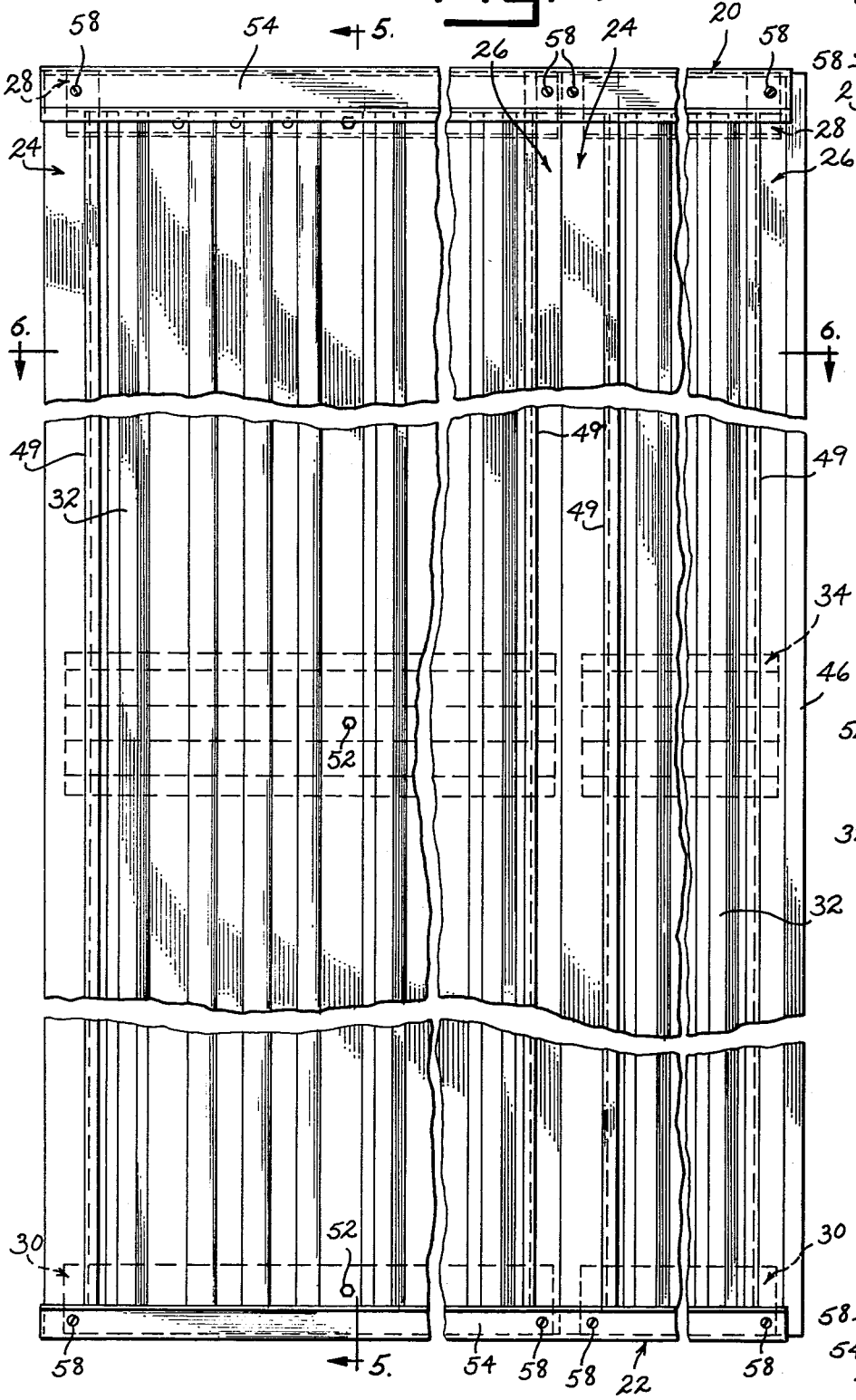
FIG. 4 is a fragmentary front elevational view of the door.
Figure 5:
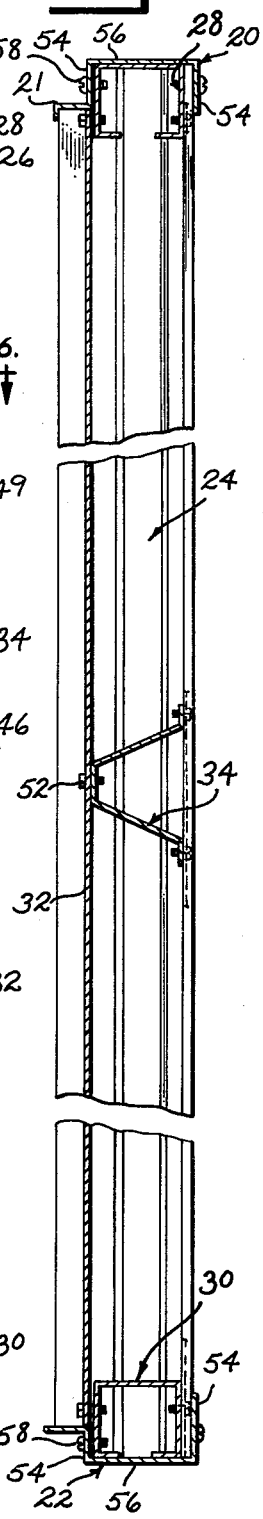
FIG. 5 is a vertical sectional view of the door taken along line 5—5 of FIG. 4.

Door 10 is shown in disassembled form in FIG. 3 and includes panel parts 18, a top rail 20 and a bottom rail 22 as its sectionalized component parts. Each panel part 18 includes vertical frame supports 24 and 26, a horizontal top girt 28, a horizontal bottom girt 30, siding 32 and also preferably one or more center girts 34.

In each panel part 18, frame support 24 is of a channel-shaped form having spaced legs 36 and a connecting web 38. Web 38 is provided with a groove 40. Each frame support 26 is also of a channel-shaped form having spaced legs 42 and a connecting web 44 which is provided with a projecting longitudinally extending tongue 46. Center girts 34, extend from frame support 24 to frame support 26 in each panel part 18 with the ends of each center girt fitting between legs 36 and 42 of the frame supports. One leg 36 and one leg 42 of each frame support 24 and 26 is provided with a groove 48 to accommodate screw fasteners 50 which extend through the frame supports into center girts 34. The other legs 36 and 42 of frame supports 24 and 26 are each provided with a channel part 49. If a single center girt 34 is utilized for a particular embodiment of door 10, this girt will preferably be centered between and parallel top girt 28 and bottom girt 30. In the illustrated embodiment of door 10, three center girts 34 are utilized with girts 28, 30 and 34 being equally spaced apart and paralleling each other.

Figure 6:
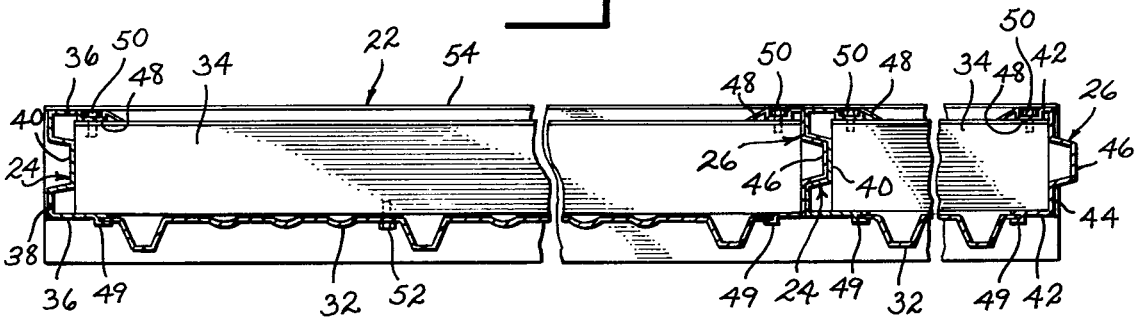
FIG. 6 is a horizontal sectional view of the door taken along line 6—6 of FIG. 4.
Figure 7:
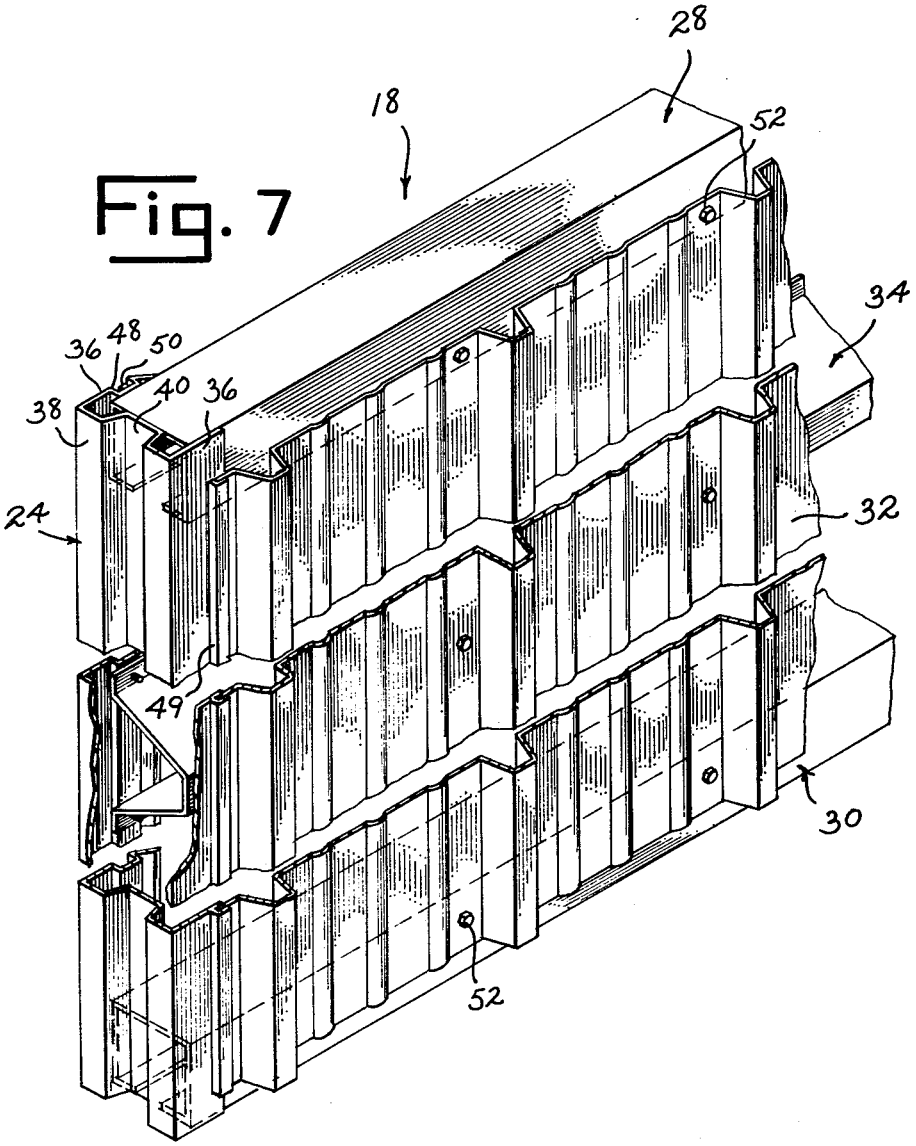
FIG. 7 is a fragmentary perspective view of the panel part component of the door with portions of the panel part broken away for purposes of illustration.
Figure 8:
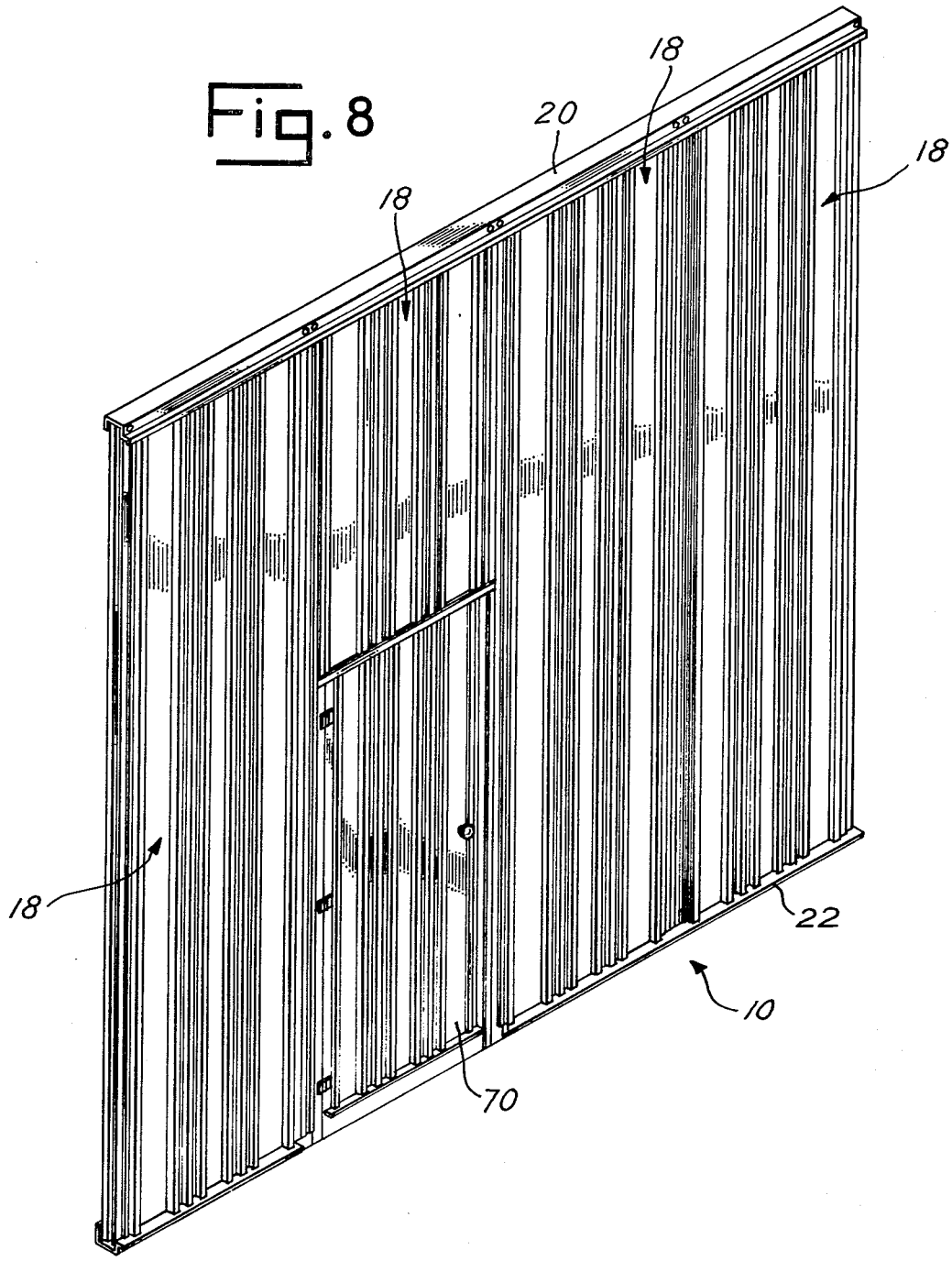
FIG. 8 is a perspective view of the door shown with a smaller entrance door incorporated therein.
Figure 9:
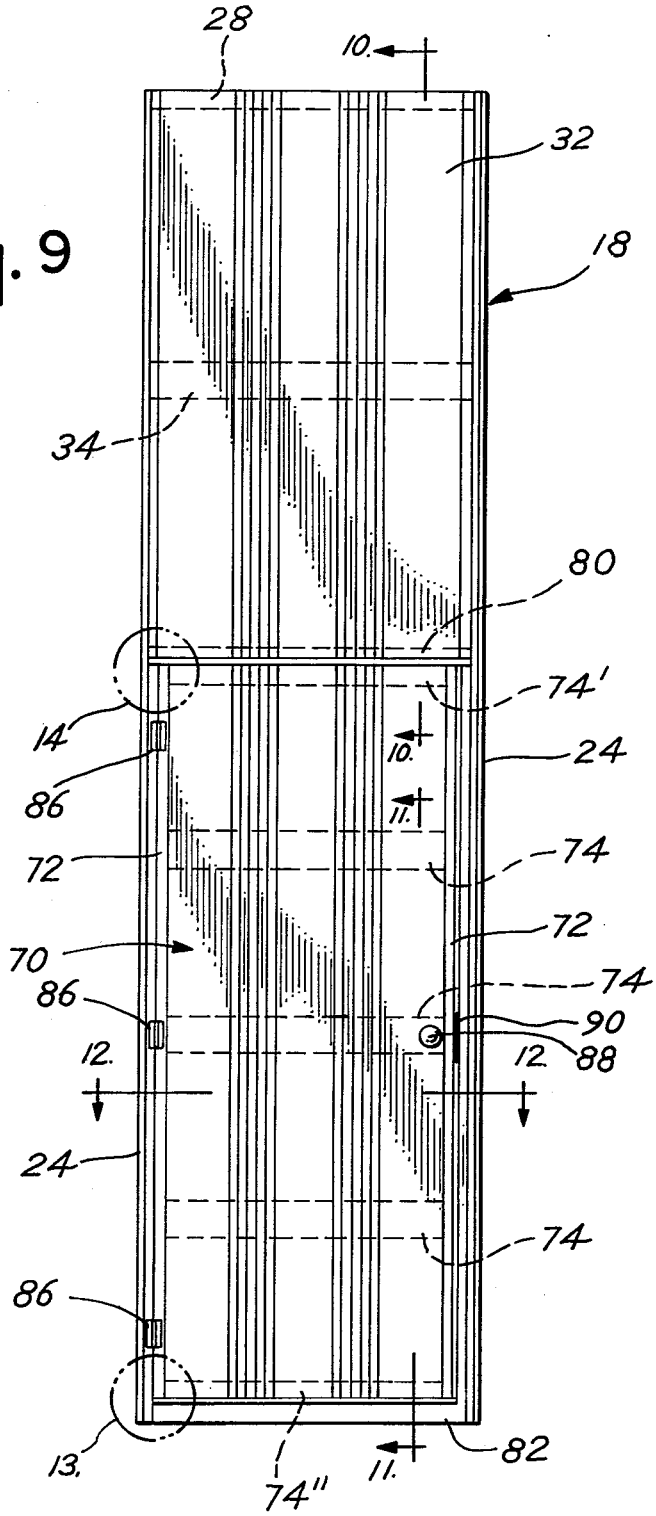
FIG. 9 is a front view of the panel part of the door of FIG. 8 having the entrance door therein.
Figure 10:
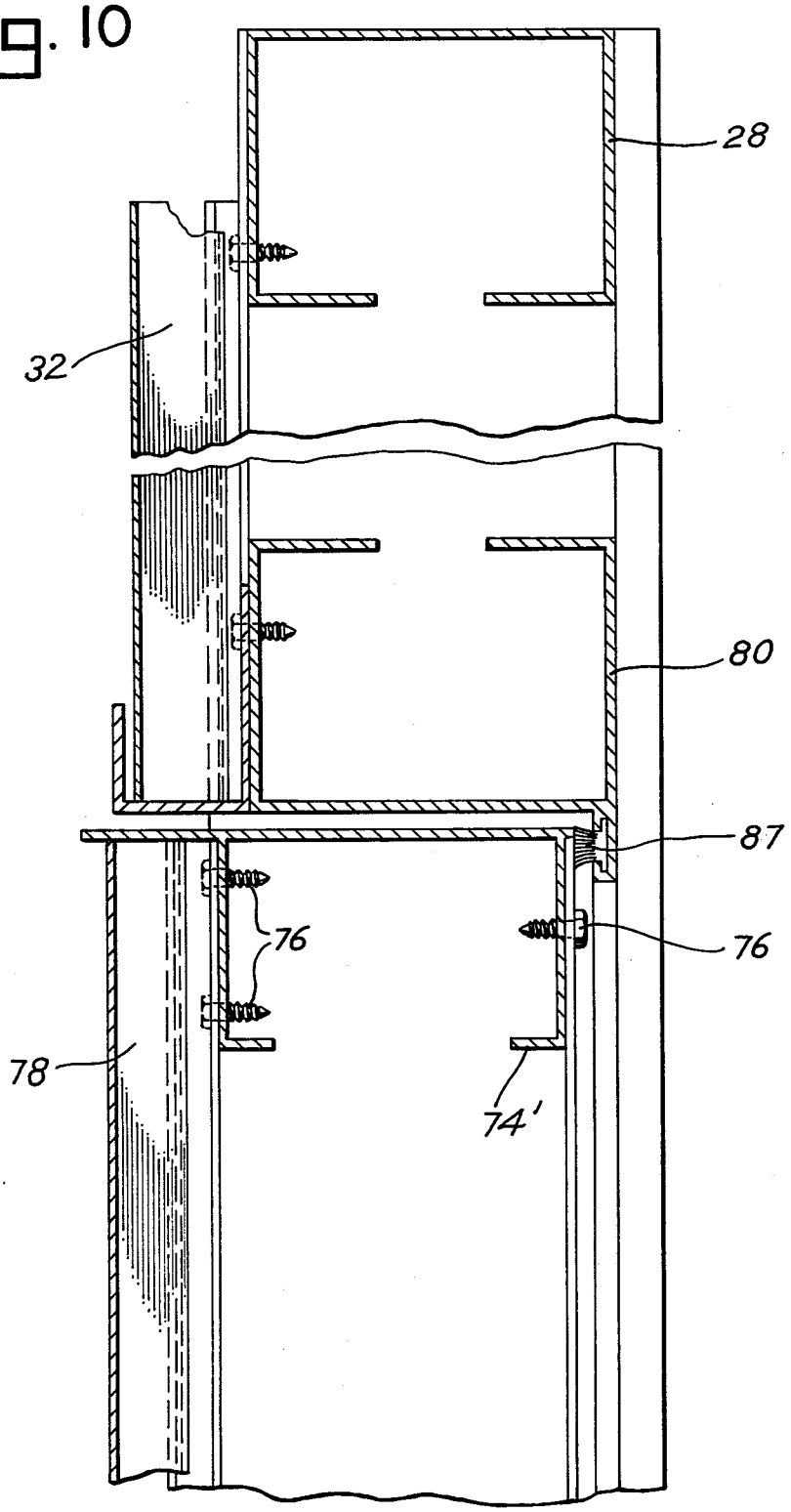
FIG. 10 is a sectional view taken along line 10—10 of FIG. 9.
Figure 11:
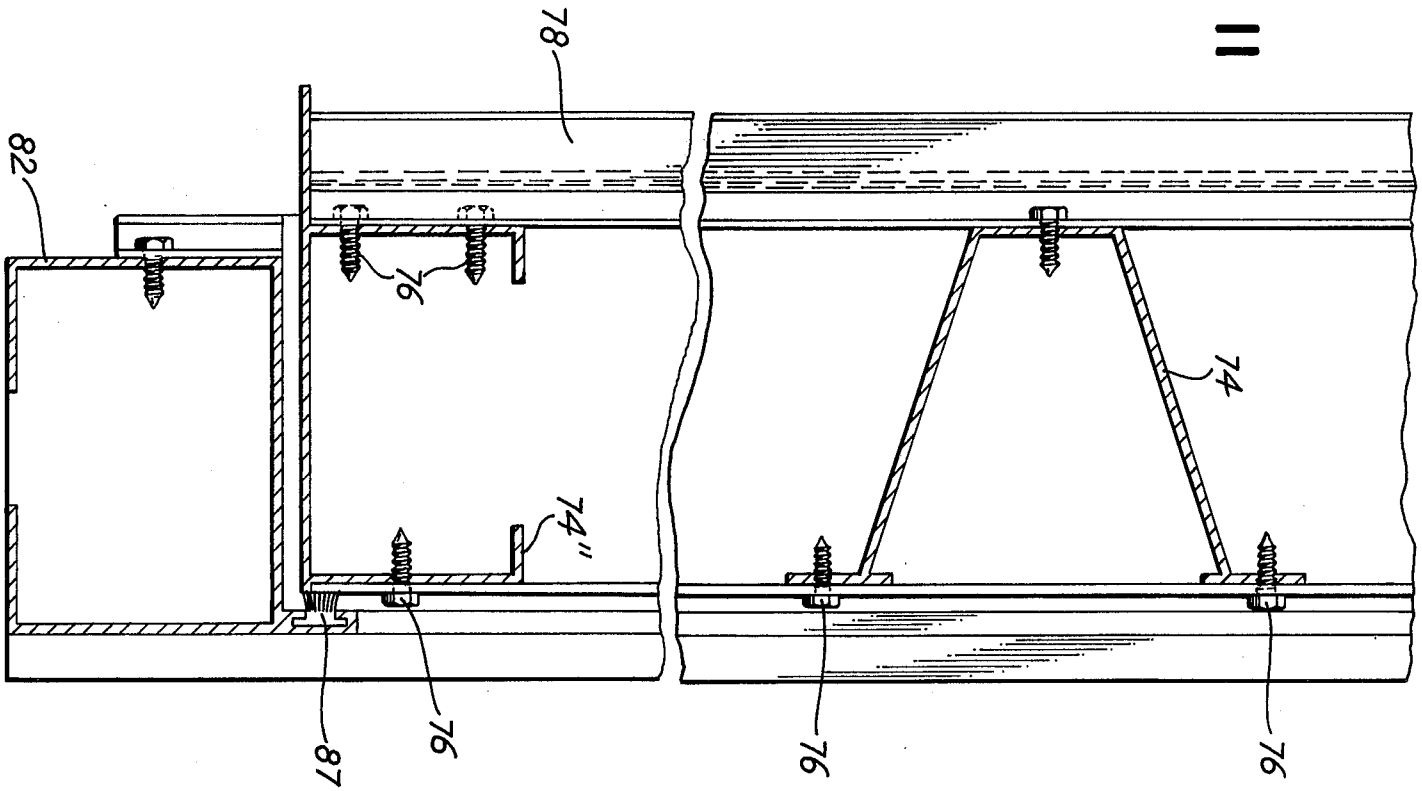
FIG. 11 is a sectional view taken along line 11—11 of FIG. 9.
Figure 12:
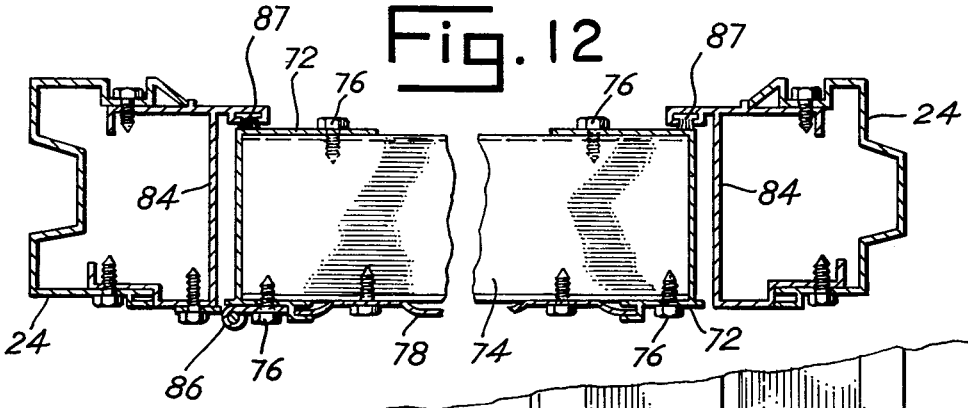
FIG. 12 is a sectional view taken along line 12—12 of FIG. 9.
Figure 13:
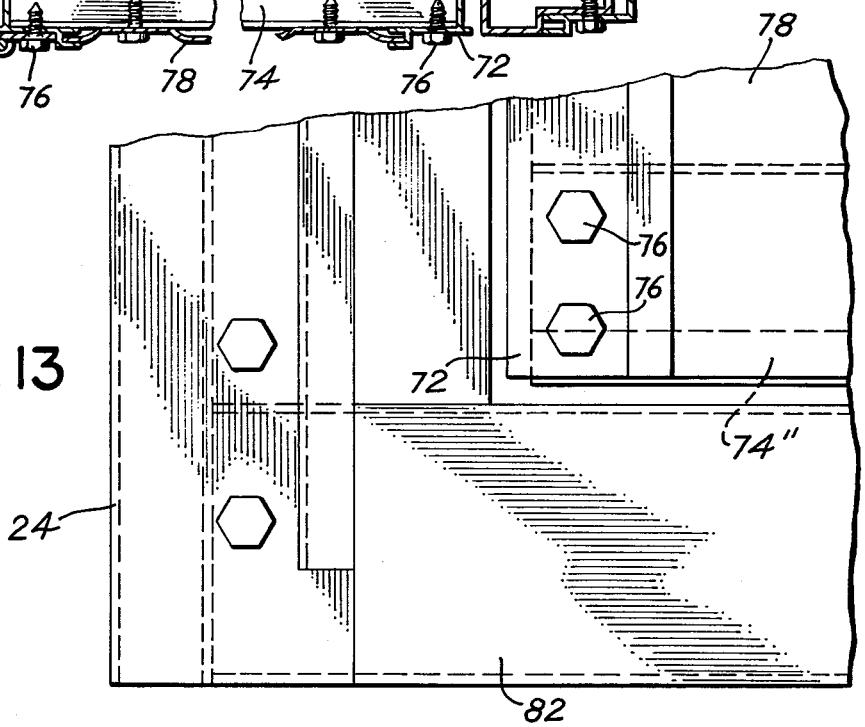
FIG. 13 is a detailed fragmentary view as seen within broken circle 13 of FIG. 9.
Figure 14:
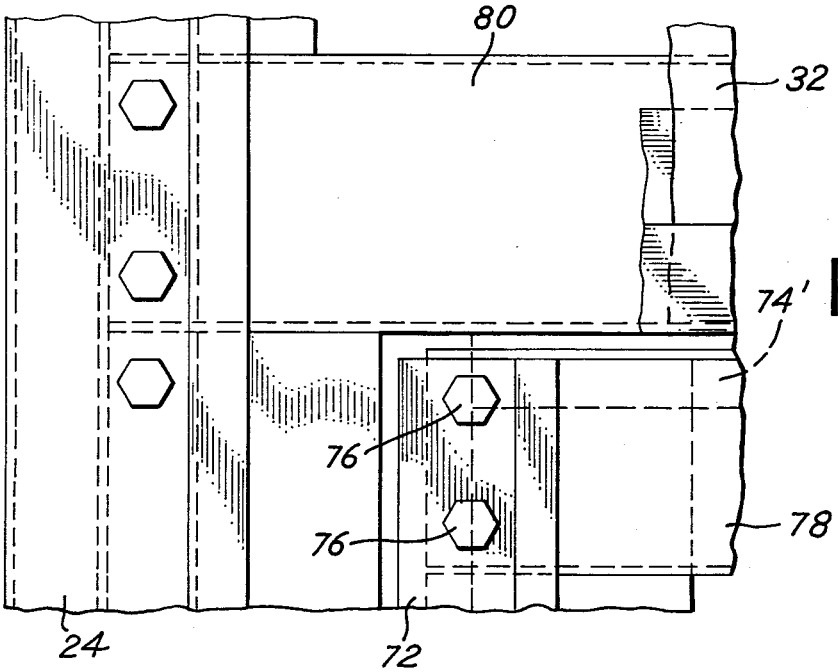
FIG. 14 is a detailed fragmentary view as seen within broken circle 14 of FIG. 9.

In each panel part 18 top girt 28 and bottom girt 30 extend from frame support 24 to frame support 26 with the ends of the girts fitting between legs 36 and 42 of frame supports 24 and 26. Screw fasteners 50 extend through frame supports 24 and 26 and girts 28 and 30 to connect the girts to the frame supports. Siding 32 is applied over girts 28, 30 and 34 of each panel part 18. The marginal edges of siding 32 extend into channel parts 49 of legs 36 and 42 of frame supports 24 and 36 as best shown in FIGS. 6 and 7. Screw fasteners 52 extend through siding 32 into girts 28, 30 and 34.

Top rail 20 and bottom rail 22 of door 10 are each channel-shaped having spaced legs 54 and a connecting web 56. Panel parts 18 of the door are positioned side by side in the same general plane with frame support tongue 46 of one panel part fitting into frame support groove 40 of the adjacent panel part. In this manner panel parts 18 of the door are connected together. The fit of each tongue 46 into the adjacent groove 40 of the panel part frame supports is preferably sufficiently close to prevent any substantial lateral movement or play between the connected panel parts. With panel parts 18 so connected together, top rail 20 is placed over the upper edges of the panel parts with legs 54 of the rail straddling the upper ends of frame supports 24 and 26 and top girt 28 of each panel part. Top rail 20 includes a projecting lip 21 which overlies the upper edge of siding 32 of each panel part 18. Bottom rail 22 is placed over the lower edges of the connected panel parts 18 with its legs 54 stradding the lower ends of frame supports 24 and 26 and bottom girt 30 of each of the panel parts. Rails 20 and 22 extend the length of connected panel parts 18. Screw fasteners 58 are inserted through legs 54 of top and bottom rails 20 and 22 and into frame supports 24 and 26 of the two end panel parts 18 and also preferably the remaining panel parts and girts 28 and 30 of the panel parts.

With panel parts 18 connected together and top rail 20 and bottom rail 22 secured to the panel parts along their respective upper and lower edges, door 10 is in its assembled form. Door 10 may now be hung upon barn 12 by attaching roller carrying hangers 14 to top rail 20 and thereafter positioning the hanger rollers upon guide rail 16.

In FIGS. 8–14, door 10 is shown with an individual door panel 70 incorporated into a panel part 18. Door panel 70 includes vertical channel sections 72, girt parts 74 which are connected by screw fasteners 76 to channel section 72, and siding 78 which is applied over one side of the panel. Girt parts 74′ and 74″ are C-shaped and serve respectively as the upper and lower transverse frame supports for the door panel. Siding 78 is attached to the channel section and girts by screw fasteners.

Panel part 18 is modified to accommodate door panel 70 by utilizing girts 80 and 82 as the header and threshold respectively for the door panel. Girts 80,82 extend into frame supports 24 and, like girts 28 and 34 are connected to the frame support by screw fasteners. Siding 32 extends from girt 28 to girt 80 and is secured to the panel part by screw fasteners. Panel part 18 with its door panel 70 is secured by tongue and groove connections to the adjacent panel parts by top rail 20 and bottom rail 22 of the door.

A channeled jamb 84 is fitted into and connected to each frame support 24, extending between girts 74′ and 74″. Hinges 86 are connected between one channel section 72 of the door panel and one jamb 84 to allow the door panel to pivot between open and closed positions relative to the accommodating panel part. Each jamb 84 and girts 74′ and 74″ includes a weather seal 87. A handle and latch 88 is carried at the opposite side edge of door panel 70 from hinges 86. A latch plate 90 is attached to the opposite jamb 84 from hinges 86 to accommodate latch 88. Door panel 70 allows access into the barn without opening door 10.

Suppliers and distributors of door 10 will sell the door in disassembled form with their inventory including a plurality of panel parts 18 and top rails 20 and bottom rails 22. Panel parts 18 will be of various widths, such as in one, two or three foot sizes and heights, such as in eight, ten, twelve, thirteen, fourteen and sixteen foot sizes. Additionally, the length of rails 20 and 22 will vary. The door buyer or user will order through the distributor or supplier a selected number and particular sized panel parts 18 which when assembled will form a door of desired size. Additionally, a top rail 20 and a bottom rail 22 of selected length will be provided or cut for the buyer or user. The door in its disassembled, sectionalized form will be transported to the building or barn site where the user or buyer by the use of ordinary hand tools will assemble the door by connecting the panel parts 18 in a side by side relationship, with the frame support tongue 46 of one panel part fitting into the frame support groove 48 of an adjacent panel part and thereafter using overlying top rail 20 and underlying bottom rail 22. Screw fasteners 50, 52, 58 and 76 may be of the self-tapping type to further facilitate assembly of the door.

It is to be understood that the invention is not to be limited to the details above given but may be modified within the scope of the appended claims.

What I claim is:

1. A door for a barn or similar structure comprising a horizontal top rail and a horizontal bottom rail, at least two separable panel parts positioned side by side and fitting between said top and bottom rails, each panel part including spaced vertical channel-shaped frame supports, one frame support of each panel part having a groove section, the other frame support of each panel part having a protruding tongue section, the frame support tongue section of one panel part fitting lockingly into the frame support groove section of another panel part with said panel parts lying in substantially the same plane, said top rail overlying said joined panel parts and being secured thereto, and means for mounting said locked panel parts to said barn or similar structure for shiftable opening and closing movement.

2. The door of claim 1 wherein each rail is of a channel-shaped form having spaced legs interconnected by a web, said joined panel parts each having upper and lower marginal portions, the upper marginal portion of each panel part fitting between said top rail legs, the lower marginal portion of each panel part fitting between said lower rail legs and fastener means connecting said rails to said panel parts.

3. The door of claim 2 wherein said one frame support of each panel part is channel-shaped having spaced legs connected by a groove defining web, said other frame support of each panel part being channel-shaped and having spaced legs connected by an elongated tongue defining web means for receiving said groove defining web of an adjacent panel part, the tongue defining web means of a said panel part fitting into the groove defining web of an adjacent said panel part.

4. The door of claim 3 wherein each panel part includes at least two girts extending from one frame support to the other frame support of the panel part, one girt constituting a component of said upper marginal portion of the panel part, another girt constituting a component of said lower marginal portion of the panel part, siding applied over said girts and extending from the upper to the lower marginal portion and from one to the other frame support of each panel part at one side of the panel part.

5. The door of claim 4 wherein each girt includes opposite end portions each fitting between legs of a said frame support.

6. The door of claim 2 wherein said fastener means connects each rail to each panel part.

7. The door of claim 3 and including a door panel carried by one of said panel parts between the frame supports thereof, hinge means connecting said door panel to one of said frame supports for opening and closing pivotal movement relative to said one panel part.

8. The door of claim 7 wherein said one panel part includes three girts extending from said one frame support to the other frame support of the panel part, a first of said girts constituting a component of said upper marginal portion of the panel part, a second of said girts constituting a component of said lower marginal portion of the panel part, the third of said girts located spacedly between said first and second girts, said door panel located between said second and third girts with the second girt constituting the header for the door panel and the third girt constituting the threshold for the door panel.

9. The door of claim 8 and siding applied over said first and third girts and extending from the upper to the lower marginal portion and from said one to said other frame support of said one panel part.

10. The door of claim 8 wherein said door panel includes spaced vertical channel sections, girt parts extending from one channel section to the other channel section, one girt part constituting the upper marginal portion and another girt part constituting the lower marginal portion of the door panel, siding applied over said girt parts and extending from the upper to the lower marginal portions of the door panel.

11. The door of claim 10 and a jamb member fitted into each frame support of said one panel part between said legs thereof, each jamb member extending from said second girt to said third girt, said door panel extending between said jamb members.

12. The door of claim 11 wherein said hinge means is connected between one of the jamb members and a channel section of the door panel.

* * * * *